US012286857B2

(12) United States Patent
Al Abdulghani et al.

(10) Patent No.: US 12,286,857 B2
(45) Date of Patent: Apr. 29, 2025

(54) REMOVING A STUCK CAP FROM A WELLBORE PRESSURE CONTROL SYSTEM

(71) Applicant: Saudi Arabian Oil Company, Dhahran (SA)

(72) Inventors: Ahmed Jassim Al Abdulghani, Al Qatif (SA); Bakur Othman Barnawi, Al Jubail (SA)

(73) Assignee: Saudi Arabian Oil Company, Dhahran (SA)

( * ) Notice: Subject to any disclaimer, the term of this patent is extended or adjusted under 35 U.S.C. 154(b) by 180 days.

(21) Appl. No.: 17/989,276

(22) Filed: Nov. 17, 2022

(65) Prior Publication Data

US 2024/0167357 A1 May 23, 2024

(51) Int. Cl.
*E21B 33/04* (2006.01)

(52) U.S. Cl.
CPC ..... *E21B 33/04* (2013.01)

(58) Field of Classification Search
CPC ..... E21B 34/02; E21B 33/03; E21B 33/04; E21B 19/16; E21B 19/18; E21B 17/021
See application file for complete search history.

(56) References Cited

U.S. PATENT DOCUMENTS 3,180,617 A 4/1965 Brown
5,188,180 A * 2/1993 Jennings ..... E21B 33/043 166/348
8,322,441 B2 12/2012 Fenton
2003/0116326 A1 6/2003 Dallas
2015/0114670 A1 4/2015 Turner
2016/0273295 A1* 9/2016 Rahim ..... E21B 33/02

OTHER PUBLICATIONS oilenco.com [online] "Creative Well Intervention Solutions," available on or before Aug. 13, 2020, via Internet Archive: Wayback Machine URL <http://web.archive.org/web/20200803095958/https://www.oilenco.com/>, retrieved on Jun. 22, 2023, URL <https://www.oilenco.com/>, 6 pages.

tmtrov.com [online], "TMT Tree Cap Puller," available on or before Apr. 19, 2021, via Internet Archive: Wayback Machine URL <http://web.archive.org/web/20210419005204/https://www.tmtrov.com.au/project/tree-cap-puller>, retrieved on Jun. 22, 2023, URL <https://www.tmtrov.com.au/project/tree-cap-puller>, 6 pages.

* cited by examiner

*Primary Examiner* — Dany E Akakpo
(74) *Attorney, Agent, or Firm* — Fish & Richardson P.C.

(57) ABSTRACT

A tool and a method removing a stuck cap from a wellbore pressure control system. The method includes removing a quick union securing a cap to a Christmas tree cap adaptor of a wellbore pressure control system sealing a wellbore. A top gauge nut positioned in the cap is removed, and then a lifting key is installed in the cap. A hydraulic jacking system is clamped around the Christmas tree cap adaptor, followed by connecting a lifting hand to the lifting key. After connecting the lifting hand to the lifting key, a lever of the hydraulic jacking system is operated. Responsive to operating the lever, the lifting hand and the lifting key move in a first direction and the cap stuck in the Christmas tree cap adaptor is removed from the Christmas tree cap adaptor.

9 Claims, 4 Drawing Sheets

REMOVING A STUCK CAP FROM A WELLBORE PRESSURE CONTROL SYSTEM

TECHNICAL FIELD

This disclosure relates to wellbore pressure control system operation.

BACKGROUND

Wellbores in an oil and gas well conduct liquid and gaseous phases of various fluids and chemicals including water, oils, and hydrocarbon gases from subterranean formations to a surface of the Earth. The fluids and gases in the wellbore can be pressurized. A wellbore pressure control system, also called a Christmas tree, is installed on the wellbore to seal the wellbore and to control the flow of oil and gas from the wellbore.

SUMMARY

This disclosure describes systems and methods related to removing a stuck cap from a wellbore pressure control system. This approach removes the stuck cap from the wellbore pressure control system with a hydraulic jacking system having a lifting hand and a lifting key. Responsive to operating hydraulic jacking system, the lifting hand and the lifting key move in a first direction to remove the stuck cap from the Christmas tree cap adaptor.

In one aspect, a method removes the stuck cap from the wellbore pressure control system. The method includes removing a quick union securing a cap to a Christmas tree cap adaptor of a wellbore pressure control system sealing a wellbore. The method includes, after removing the quick union, removing a top gauge nut positioned in the cap. The method includes, after removing the top gauge nut, installing a lifting key in the cap. The method includes, after installing the lifting key in the cap, clamping a hydraulic jacking system around the Christmas tree cap adaptor. The method includes, after clamping the hydraulic jacking system around the Christmas tree cap adaptor, connecting a lifting hand of the hydraulic jacking system to the lifting key. The method includes, after connecting the lifting hand to the lifting key, operating a lever of the hydraulic jacking system. The method includes, responsive to operating the lever, moving the lifting hand and the lifting key in a first direction. The method includes removing the cap stuck in the Christmas tree cap adaptor from the Christmas tree cap adaptor.

In some implementations, removing the top gauge nut includes unscrewing the top gauge nut from a threaded void in the cap. In some cases, installing the lifting key in the threaded void of the cap includes screwing the lifting key into the threaded void of the cap.

In some implementations, clamping the hydraulic jacking system to the Christmas tree cap adaptor includes clamping the hydraulic jacking system around a flange of the Christmas tree cap adaptor.

In some implementations, the lifting hand includes a hook, the lifting key includes a ring, and connecting the lifting hand to the lifting key includes engaging the hook to the ring.

In some implementations, operating the lever includes: responsive to operating the lever, actuating a piston; responsive to actuating the piston, increasing a differential pressure across the piston; and responsive to increasing the differential pressure across the piston, moving the lifting hand and the lifting key to remove the cap stuck in the Christmas tree cap adaptor. In some cases, the method further includes responsive to operating the lever, decreasing the differential pressure across the piston. In some cases, responsive to decreasing the differential pressure across the piston, the method further includes moving the lifting hand in a second direction opposite the first direction to disengage the lifting hand from the lifting key.

In some implementations, the method further includes unclamping the hydraulic jacking system from around the Christmas tree cap adaptor. In some implementations, the method further includes removing the lifting key from a threaded void of the cap.

In some implementations, before removing the quick union securing the cap to the Christmas tree cap adaptor, the method further includes removing the top gauge nut positioned in the cap; after removing the top gauge nut, installing a pressure gauge on the Christmas tree cap adaptor; performing a pressure test on the wellbore; removing the pressure gauge from the Christmas tree cap adaptor; and installing the top gauge nut in the Christmas tree cap adaptor. In some cases performing the pressure test on the wellbore includes operating a control valve of the wellbore pressure control system; and responsive to operating the control valve, applying a wellbore pressure to the pressure gauge.

In another aspect, a tool removes a stuck cap from a Christmas tree cap adaptor. The tool includes a hydraulic jacking system and a lifting key. The hydraulic jacking system includes a housing sleeve, a piston coupled to the housing sleeve, a lever coupled to the piston, a lifting hand coupled to and extending from the piston, and a hydraulic reservoir fluidly coupled to the piston and the housing sleeve, the hydraulic reservoir containing a hydraulic fluid. The lifting key engages the cap coupled to a Christmas tree cap adaptor of a wellbore pressure control system. The lifting hand of the hydraulic jacking system engages the lifting key to remove the cap from the Christmas tree cap adaptor responsive to operating the lever.

In some implementations, the housing sleeve clamps on to a Christmas tree cap adaptor of the wellbore pressure control system.

In some implementations, the housing sleeve actuates to clamp on to a Christmas tree cap adaptor of the wellbore pressure control system.

In some implementations, the housing sleeve includes a first portion having a first end and a second end, a second portion having a first end and a second end, and the first end of the first portion and the first end of the second portion are coupled together and the second end of the first portion and the second end of the second portion are coupled together. In some cases, the tool includes a spring hinge rotatably coupling the first end of the first portion to the first end of the second portion and a lock positioned on the second end of the first portion to optional lock the second end of the first portion to the second end of the second portion.

In some implementations, an inner surface of the housing sleeve includes grooves.

In some implementations, the lifting hand further includes a hook extending from the lifting hand to engage the lifting key.

In some implementations, the lifting key includes a shaft and a ring. The shaft has a first end and a second end. The first end couples to the cap. The ring is coupled to the second end. The lifting hand engages the ring to remove the cap from the Christmas tree cap adaptor.

In some implementations, the hydraulic reservoir supplies the hydraulic fluid to the piston when the lever is operated to move the lifting hand.

Implementations of the present disclosure can realize one or more of the following advantages. These systems and methods can decrease wellhead maintenance activities and testing time. For example, conventionally, a crane or a maintenance team can pull, a stuck cap from a Christmas tree cap adaptor. Cranes or a metal crew may not be present at the location of the stuck cap, requiring a crane or a welder be called to the location. The time required to arrange and transport the crane or the metal crew to the location of the stuck cap in the Christmas tree adaptor can increase the time required to perform the intended operation in the well. Using a tool including a hydraulic jacking system having a lifting hand and a lifting key according to the implementations of the present disclosure with the personnel at the location can decrease the total standby time for the maintenance activity on the wellhead.

These systems and methods can improve personnel safety. For example, removing a cap stuck on the Christmas tree cap adaptor by a crane or maintenance team can entail overhead lifting operations, upper flange removal, or a heat application, which can be dangerous to personnel. By removing the stuck cap from the Christmas tree cap adaptor with the hydraulic jacking system having the lifting hand and the lifting key according to the implementations of the present, the overhead lifting operations, upper flange removal, or heating may no longer be necessary, improving personnel safety and saving time.

These systems and methods can reduce a quantity of emergency tickets issued to avail specialized personnel with special equipment to the location to resolve a stuck cap problem. In some cases, stuck caps can lead to several negative consequences including increased operation standby times.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

An oil and gas well has a wellbore extending from a surface of the Earth to subterranean formations in the Earth. The subterranean formations contain liquid and gaseous phases of various fluids and chemicals including water, oils, and hydrocarbon gases. The wellbore conducts the fluids and chemicals from the subterranean formations to the surface. A wellbore pressure control system is installed on the surface of the Earth and coupled to the wellbore to seal the wellbore and to control the flow of oil and gas from the wellbore. The wellbore pressure control system can include multiple components including isolation valves, blowout preventers, chokes, spools, and a cap. The cap can placed on top of the Christmas tree to protect the Christmas tree and provide access to the wellbore. Sometimes, the cap can be removed to perform maintenance or testing on the wellbore or wellbore pressure control system. Sometimes, the cap can become stuck, hindering the removal of the cap to perform the maintenance or testing on the wellbore or wellbore pressure control system.

The present disclosure relates to removing a stuck cap from a wellbore pressure control system. This approach removes the stuck cap from the wellbore pressure control system (i.e., a Christmas tree installed on a wellbore) with a hydraulic jacking system having a lifting hand and a lifting key. The stuck cap can be removed by removing a quick union securing the cap to the Christmas tree cap adaptor. After removing the quick union, a top gauge nut positioned in the cap can be removed. After removing the top gauge nut, the lifting key can be installed in the cap. After installing the lifting key in the cap, the hydraulic jacking system can be clamped around the Christmas tree cap adaptor. After clamping the hydraulic jacking system around the Christmas tree cap adaptor, the lifting hand of the hydraulic jacking system can be connected to the lifting key. After connecting the lifting hand to the lifting key, a lever of the hydraulic jacking system can be operated. Responsive to operating the lever, the lifting hand and the lifting key can be moved in a first direction. The cap stuck in the Christmas tree cap adaptor can be removed.

Figure 1A:
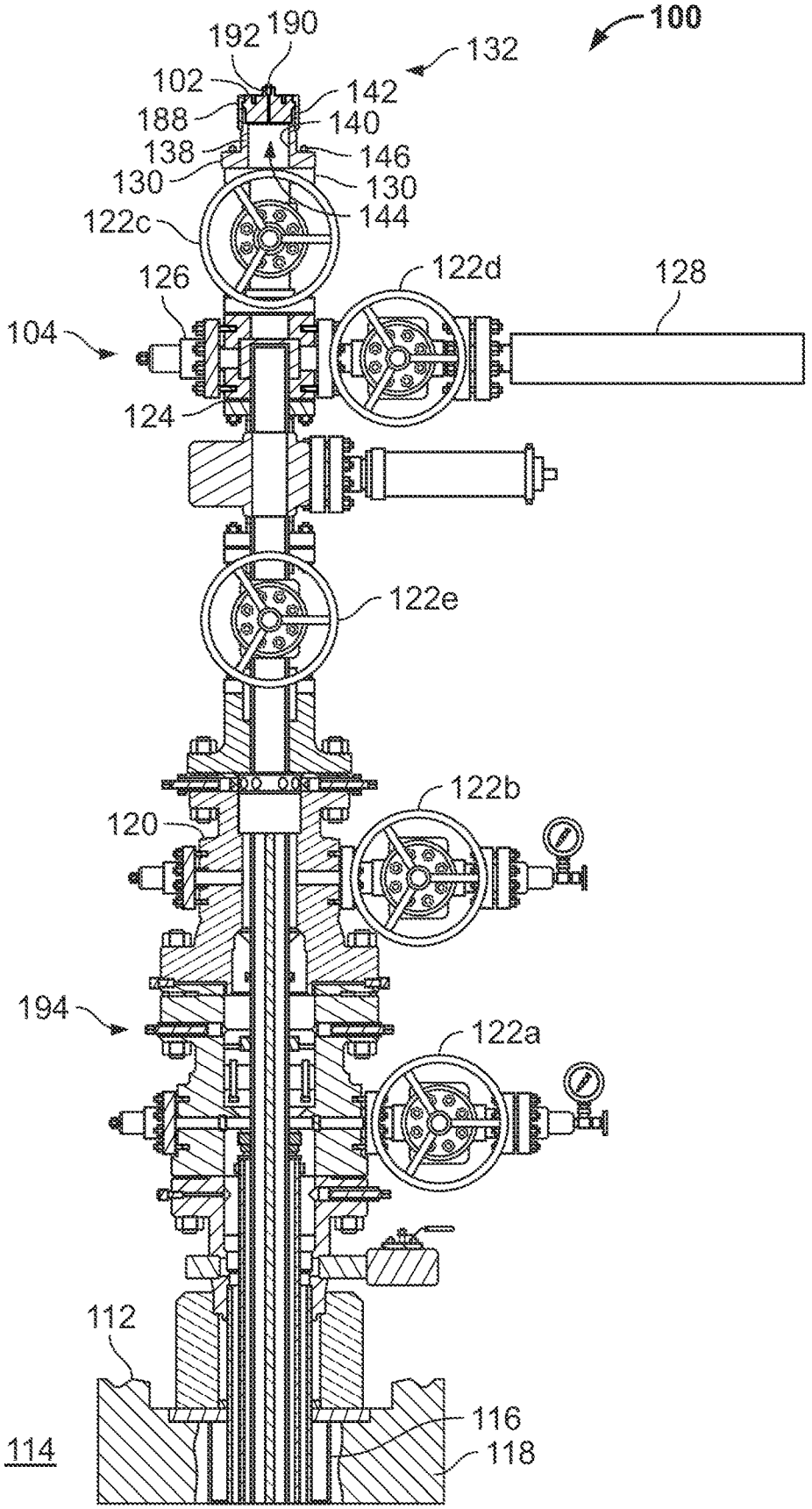
FIG. 1A is a front view of a wellbore pressure control system Christmas tree.

FIG. 1A is a front view of a wellbore pressure control system Christmas tree. The wellbore pressure control system 104 (i.e., a Christmas tree) is installed on a wellhead assembly 194 positioned on and coupled to a surface 112 of the Earth 114 and to control a pressure and a flow of flow of fluid into or out of the wellbore 116. The wellbore 116 extends from the surface 112 of the Earth 114 into subterranean formations 118 which contain fluids such as liquids and gases including water and hydrocarbons. The wellbore 116 conducts the fluids from the subterranean formations to the surface 112. The wellbore pressure control system 104 controls a flow of the fluids from the wellbore 116.

The wellhead assembly 194 has a tubing bonnet adaptor 120 connected the wellbore pressure control system 104. A tubing 196 is coupled to and extends from the tubing bonnet adaptor 120 into the wellbore 116 to flow the fluids from the wellbore 116 to the Christmas tree 104. The wellhead assembly 194 has control valves such as a lower master valve 122*a* and an upper master valve 122*b* which can open and close to control a fluid flow through the wellhead assembly 194.

The wellbore pressure control system 104 also has control valves such as a crown valve 122*c*, and a wing valve 122*d*, and a master control valve 122*e* which can open and close to control a fluid flow. The wellbore pressure control system 104 can include a cross connection 124 to conduct or change the direction of the fluid flow through the wellbore pressure control system 104.

The wellbore pressure control system 104 can include a choke assembly 128 coupled to one of the control valves, such as the wing valve 122*d*, to reduce a flow rate or a pressure of the fluid flow out of the wellbore 116. The various components of the wellbore pressure control system 104 can include flanges 130 to couple to other wellbore pressure control system 104 components.

The wellbore pressure control system 104 includes a Christmas tree cap adaptor 132 through which a pressure inside the wellbore pressure control system 104 can be sensed. The Christmas tree cap adaptor 132 is coupled to the crown valve 122*c*. However, in an alternative configuration, the Christmas tree cap adaptor 132 can be coupled to other components of the wellbore pressure control system 104.

The Christmas tree cap adaptor 132 has a body 136 which has an outer surface 138 and an inner surface 140. A portion 142 of the outer surface 138 of the body 136 is threaded. The inner surface 140 defines an internal void 144. The Christmas tree cap adaptor 132 has a flange 130 coupled to the body 136 which mates to another flange 130 of the wellbore pressure control system 104. Multiple fasteners 146 pass through the flanges 130 to mechanically couple the flanges 130 together. The cap 102 body 136 has an internal void 192 extending through the cap 102. The internal void 192 is threaded to accept a pressure gauge 134 (described in more detail in reference to FIG. 1B).

The wellbore pressure control system 104 includes the cap 102. The cap 102 is positioned in the Christmas tree cap adaptor 132 in the internal void 144 of the body 136 against the inner surface 140 to seal against and protect the inner surface 140. Over a period of time, some water or moisture can ingress along the inner surface 140 and the cap 102 which can result in corrosion forming on the inner surface 140 and the cap 102. The corrosion between the inner surface 140 of the body 136 and the cap 102 can cause the cap 102 to be hard to remove, i.e., a stuck cap 102. In other words, the force required to remove the cap 102 from the Christmas tree cap adaptor 132 exceeds a threshold force. The longer this condition exists, the more welded the contact surfaces (the inner surface 140 and the cap 102) can become and the higher force required to remove the cap 102 from the Christmas tree cap adaptor 132. In some instances, the Christmas tree cap adaptor 132 can be unprotected under harsh or extreme weather conditions, subjecting the Christmas tree cap adaptor 132 susceptible to wear, corrosion, and rust. The cap 102 can be removed to perform testing or maintenance on the wellhead (the wellbore pressure control system 104) or wellbore 116.

The wellbore pressure control system 104 includes a quick union 188 to hold the cap 102 in the internal void 144. The quick union 188 has an inner threaded surface (not shown) which engages the threaded portion 142 of the outer surface 138 of the body 136. In some cases, the pressure in the wellbore pressure control system 104 can force fluid past the cap 102 and the inner surface 140 of the body 136 of Christmas tree cap adaptor 132.

The wellbore pressure control system 104 includes a top gauge nut 190. The top gauge nut 190 can also be referred to as a pipe plug. The top gauge nut 190 can plug the internal void 192 of the cap 102.

Figure 1B:
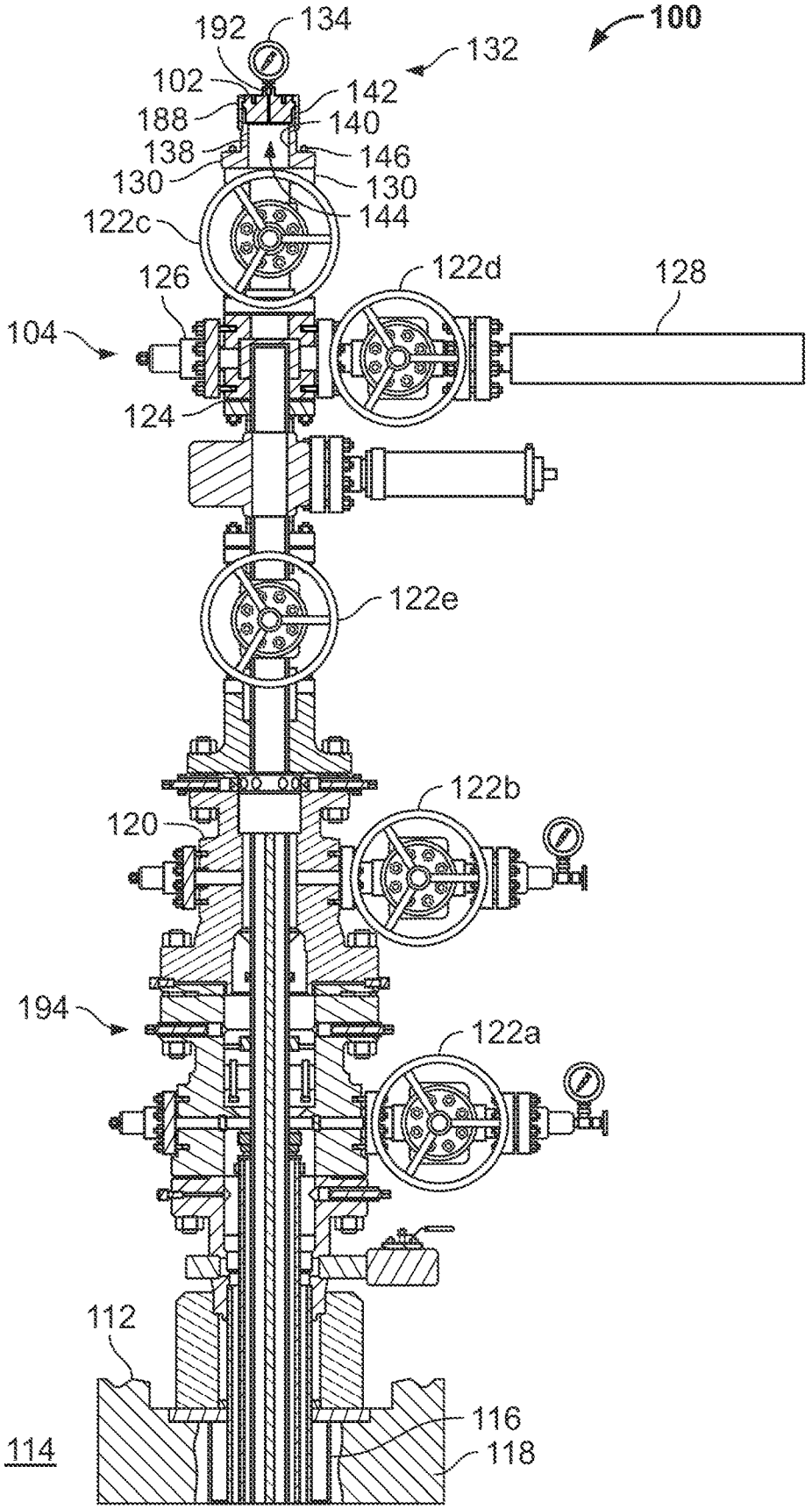
FIG. 1B is a front view of the Christmas tree of FIG. 1A with a pressure gauge installed on the top.

FIG. 1B is a front view of the Christmas tree of FIG. 1A with a pressure gauge installed on the top. The pressure gauge 134 can be coupled to the Christmas tree cap adaptor 132. Responsive to opening the crown valve 122*c*, the pressure sensed by the pressure gauge is the pressure in the spool 124. Responsive to opening the master control valve 122*e*, the pressure in the spool 124 is the wellbore 116 pressure. Responsive to opening the crown valve 122*c* and the master control valve 122*e*, the pressure gauge 134 senses the pressure in the wellbore 116.

Figure 1C:
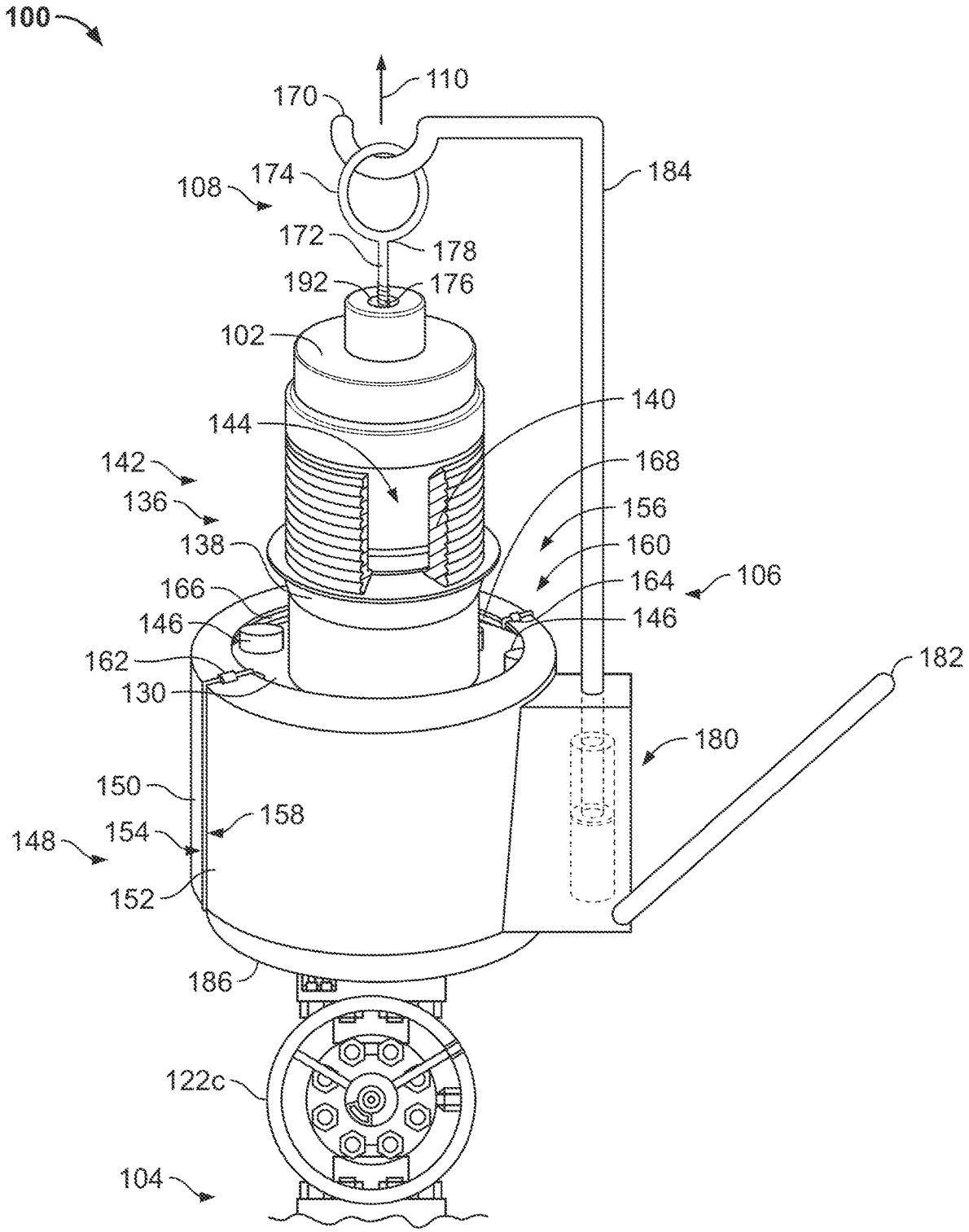
FIG. 1C is a schematic view of a tool removing the stuck cap from the Christmas tree cap adaptor of FIG. 1A.

FIG. 1C is a schematic view of a tool removing the stuck cap from the Christmas tree cap adaptor of FIG. 1A. The tool 100 is coupled to the wellbore pressure control system 104 and operated to remove the stuck cap 102 from the wellbore pressure control system 104. The tool 100 includes a hydraulic jacking system 106 and a lifting key 108. The hydraulic jacking system 106 is coupled to the wellbore pressure control system 104. The lifting key 108 is coupled to the cap 102 and the hydraulic jacking system 106. The hydraulic jacking system 106 is operated to move lifting key 108 in the direction of arrow 110 to remove the stuck cap 102 from the wellbore pressure control system 104.

The hydraulic jacking system 106 has a housing sleeve 148, a piston 180 coupled to the housing sleeve 148, a lever 182 coupled to the piston 180, a lifting hand 184 coupled to and extending from the piston 180, and a hydraulic reservoir 186 fluidly coupled to the piston 180 and the housing sleeve 148. The lifting hand 184 couples to the lifting key 108 engaged to the cap 102. An operator (not shown) operates the lever 182 to move the lifting hand 184 and the lifting key 108 in the direction of arrow 110.

The housing sleeve 148 clamps on to the Christmas tree cap adaptor 132. In some cases, the housing sleeve 148 can actuate to clamp on to the Christmas tree cap adaptor 132. The housing sleeve 148 can clamp on to the flange 130. Alternatively or in addition, the housing sleeve 148 can clamp on to the body 136 of Christmas tree cap adaptor 132.

The housing sleeve 148 has a first portion 150 and a second portion 152. The first portion 150 has a first end 154 and a second end 156. The second portion 152 has a first end 158 and a second end 160. The first end 154 of the first portion 150 and the first end 158 of the second portion 152 are coupled together and the second end 156 of the first portion 150 and the second end 160 of the second portion 152 are coupled together. The first portion 150 and the second portion 152 can actuate about the either the first ends 154, 158 or the second ends 156, 160 (i.e., the housing sleeve 148 can open or close) to position the housing sleeve 148 about the Christmas tree cap adaptor 132. In some cases, both the first ends 154, 158 and the second ends 156, 160 can separate to position the first portion 150 and the second portion 152 about the Christmas tree cap adaptor 132.

The hydraulic jacking system 106 can include a spring hinge 162 and a lock 164. The spring hinge 162 can be positioned in between and coupled to the first end 154 of the first portion 150 and the first end 158 of the second portion 152. The first portion 150 and the second portion 152 can rotate relative to each other about the spring hinge 162. In other words, the first portion 150 and the second portion 152 are rotatably coupled by the spring hinge 162. The lock 164 can be positioned on the second end 156 of the first portion 150 to optional lock the second end 156 of the first portion 150 to the second end 160 of the second portion 152. For example, the lock 164 can be a pin.

Alternatively or in addition, the hydraulic jacking system 106 can include multiple locks 164. For example, the multiple locks 164 can be additional fasteners (not shown) such as bolts or bolts and nuts extending through a portion of the first portion 150 and the second portion 152 to couple the first portion 150 to the second portion 152. In some cases, the housing sleeve 148 can include additional flanges (not shown) having voids sized to accept the additional fasteners and the additional flanges extend from the first ends 154, 156 and the second ends 158, 160. The additional fasteners can pass through the voids of the additional flanges and lock the first portion 150 to the second portion 152.

In some cases, an inner surface 166 of the housing sleeve 148 has grooves 168. The grooves 168 can couple to the flange 130 or the body 136 to increase a holding force of the housing sleeve 148 relative to the flange 130 or the body 136.

The hydraulic reservoir 186 is filled with a hydraulic fluid. The hydraulic reservoir 186 supplies the hydraulic fluid to the piston 180 Responsive to opening the lever 182 being operated. Suppling the hydraulic fluid to the piston 180 can increase a differential pressure across the piston 180 to move the piston 180. The piston 180 is coupled to the lifting hand 184. Operating the lever 182 to flow the hydraulic fluid to the piston 180 moves the piston 180 and the lifting hand 184 in the direction of arrow 110 to remove the cap 102 from the Christmas tree cap adaptor 132. Sometimes, the lever 182 can be operated to decrease the differential pressure across the piston 180 to move the piston in the opposite direction of arrow 110, disengaging the lifting hand 184 from the lifting key 108.

The lifting hand 184 has a hook 170 extending from the lifting hand 184. The hook 170 engages the lifting key 108. The lever 182 is operated to move the piston 180, the hook 170 of the lifting hand 184 moves in the direction of arrow 110 to engage the lifting key 108. Subsequent operation of the lever 182 applies a force to the lifting key via the hook 170 in the direction of arrow 110 and removes the cap 102 from the Christmas tree cap adaptor 132.

The lifting key 108 has a shaft 172 and a ring 174 coupled to the shaft 172. The shaft 172 has a first end 176 and a second end 178. The first end 176 is configured to couple to the cap 102. For example, the first end 176 is threaded to engage the cap 102. The lifting key 108 is tightened and threaded in the internal void 192. The second end 178 of the shaft 172 is coupled to the ring 174. The hook 170 is placed inside the ring 174 and the hook 170 is moved to couple to the ring 174 to move the cap 102.

Figure 2:
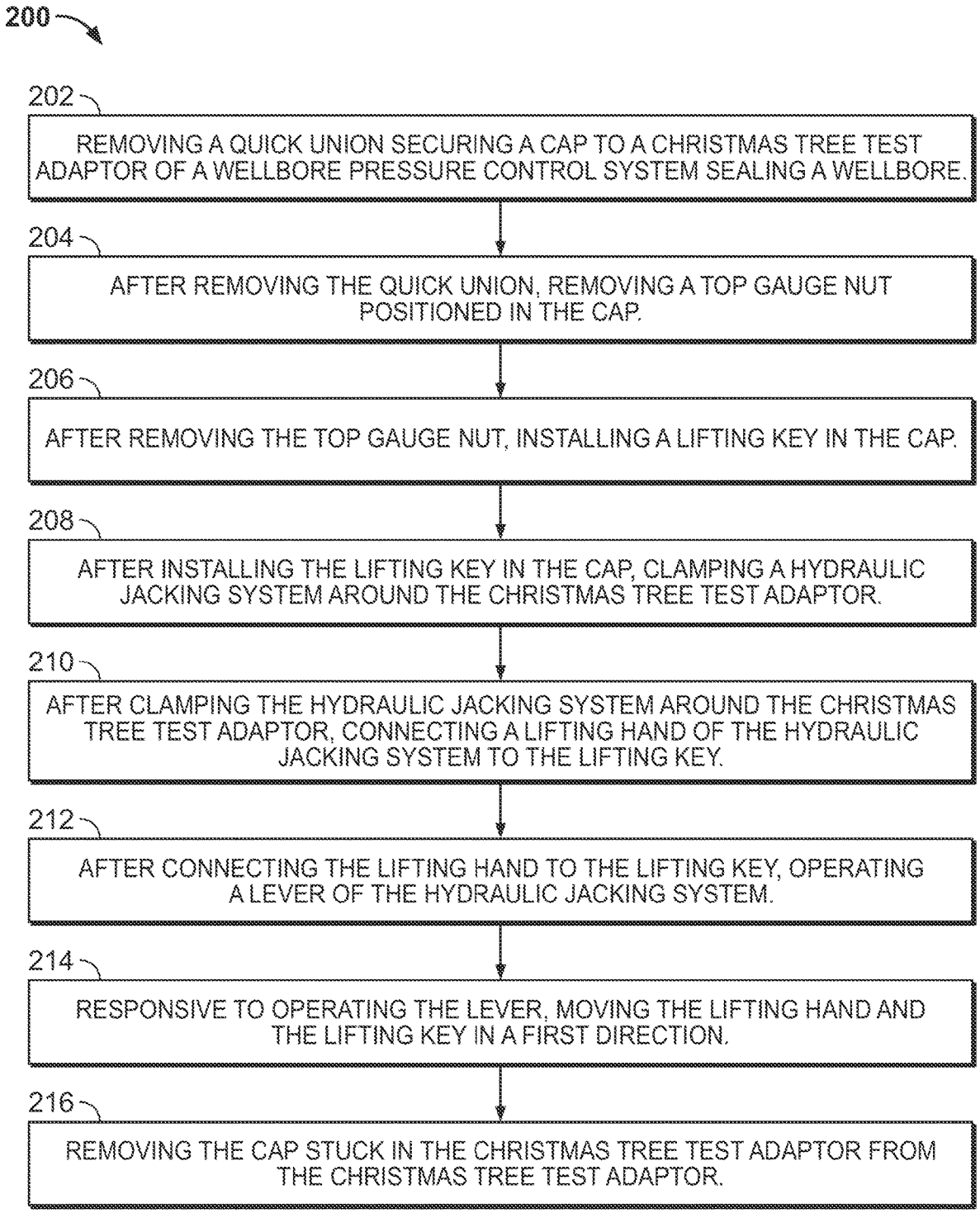
FIG. 2 is a flow chart of an example method of removing a stuck cap from a wellbore pressure control system according to implementations of the present disclosure.

FIG. 2 is a flow chart 200 of an example method of removing a stuck cap from a wellbore pressure control system according to the implementations of the present disclosure. At 202, a quick union securing a cap to a Christmas tree cap adaptor of a wellbore pressure control system sealing a wellbore is removed from the Christmas tree cap adaptor. For example, the quick union 188 can be spun or turned in a counter-clockwise direction to remove the quick union 188 from the threaded portion 142 of the Christmas tree cap adaptor 132. The wellbore pressure control system 104 is coupled to the wellbore 116 to control fluid flow to and from the wellbore 116. The quick union 188 is removed to allow the operator to attempt to remove the cap 102 from the internal void 144 by hand. When the operator is unable to remove the cap 102 from the internal void 144 by hand, the cap 102 is stuck in the internal void 144.

At 204, after removing the quick union, a top gauge nut positioned in the cap is removed from the cap. In some implementations, removing the top gauge nut includes unscrewing the top gauge nut from a threaded void in the cap. For example, the top gauge nut 190 can be spun or turned in a counter-clockwise direction to remove the top gauge nut 190 from the internal void 192 of the cap 102. Since the operator is unable to remove the cap 102 from the internal void 144 by hand, the top gauge nut 190 will need to be removed from the stuck cap 102 to allow the lifting key 108 to be placed in the internal void 192 of the cap 102.

At 206, after removing the top gauge nut, a lifting key is installed in the cap. In some implementations, installing the lifting key in the threaded void of the cap includes screwing the lifting key into the threaded void of the cap. For example, the lifting key 108 can be spun or turned in a clock-wise direction into the internal void 192 of the cap 102.

At 208, after installing the lifting key in the cap, a hydraulic jacking system is clamped around the Christmas tree cap adaptor. In some implementations, clamping the hydraulic jacking system to the Christmas tree cap adaptor includes clamping the hydraulic jacking system around a flange of the Christmas tree cap adaptor. For example, the first portion 150 and the second portion 152 are placed about the Christmas tree cap adaptor 132 and the lock 164 fastens the first portion 150 to the second portion 152. The hydraulic jacking system 106 is clamped around the Christmas tree cap adaptor 132 after installing the lifting key 108 in the cap 102 to position the hook 170 in the ring 174.

At 210, after clamping the hydraulic jacking system around the Christmas tree cap adaptor, a lifting hand of the hydraulic jacking system is connected to the lifting key. In some implementations, the lifting hand includes a hook, the lifting key includes a ring, and connecting the lifting hand to the lifting key includes engaging the hook to the ring. For example, the hook 170 of the lifting hand 184 can be coupled to the ring 174 of the lifting key 108. Since the hook 170 has been positioned in the ring 174, the shaft 184 can be moved in the direction of arrow 110 to engage the hook 170 to the ring 174.

At 212, after connecting the lifting hand to the lifting key, a lever of the hydraulic jacking system is operated. In some implementations, operating the lever includes: responsive to operating the lever, actuating a piston; responsive to actuating the piston, increasing a differential pressure across the piston; and responsive to increasing the differential pressure across the piston, moving the lifting hand and the lifting key to remove the cap stuck in the Christmas tree cap adaptor. For example, the lever 182 can be operated by the operator to flow the hydraulic fluid from the hydraulic reservoir 186 to the piston 180.

At 214, responsive to operating the lever, the lifting hand and the lifting key are moved in a first direction. For example, the lifting hand 184 can be moved in the direction of arrow 110

At 216, the cap stuck in the Christmas tree cap adaptor is removed from the Christmas tree cap adaptor. For example, the cap 102 can be detached from the Christmas tree cap adaptor 132.

In some implementations, either before or after removing the stuck cap from the Christmas tree, responsive to operating the lever, the differential pressure across the piston is decreased. In some cases, responsive to decreasing the differential pressure across the piston, the lifting hand moves in a second direction opposite the first direction to disengage the lifting hand from the lifting key. For example, the lifting hand 184 can move in the direction opposite arrow 110 to disengage from the lifting key 108.

In some implementations, after removing the stuck cap from the Christmas tree, the method includes unclamping the hydraulic jacking system from around the Christmas tree cap adaptor. For example, the lock 164 can be removed or actuated and the first portion 150 and the second portion 152 can rotate about the spring hinge 162 to decouple from and move away from the flange 130 of the Christmas tree cap adaptor 132.

In some implementations, after removing the stuck cap from the Christmas tree, the method includes removing the lifting key from a threaded void of the cap. For example, the lifting key 108 can be rotated in the counter-clockwise direction to unscrew from the internal void 192.

In some implementations, before removing the quick union securing the cap to the Christmas tree cap adaptor, the method includes: removing the top gauge nut positioned in the cap; after removing the top gauge nut, installing a pressure gauge on the Christmas tree cap adaptor; performing a pressure test on the wellbore; removing the pressure gauge from the Christmas tree cap adaptor; and installing the top gauge nut in the Christmas tree cap adaptor. In some cases, performing the pressure test on the wellbore includes: operating a control valve of the wellbore pressure control system; and responsive to operating the control valve, applying a wellbore pressure to the pressure gauge. For example, the top gauge nut 190 can be removed from the cap 102. The pressure gauge 134 can be installed in the internal void 192 of the cap 102. The crown valve 122*c* can be cycled open and closed while the master control valve 122*e* is open, exposing the pressure gauge 134 to wellbore 116 pressure.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

The invention claimed is:

1. A tool comprising:

a hydraulic jacking system comprising:

a housing sleeve comprising at least two portions, the at least two portions separable to couple about a Christmas tree cap adaptor of a wellbore pressure control system;

a piston coupled to the housing sleeve;

a lever coupled to the piston;

a lifting hand coupled to and extending from the piston; and a hydraulic reservoir fluidly coupled to the piston and the housing sleeve, the hydraulic reservoir containing a hydraulic fluid; and a lifting key configured to engage a cap coupled to the Christmas tree cap adaptor of the wellbore pressure control system, wherein the lifting hand of the hydraulic jacking system engages the lifting key to remove the cap from the Christmas tree cap adaptor responsive the lever being operated.

2. The tool of claim 1, wherein the housing sleeve is configured to clamp on to the Christmas tree cap adaptor of the wellbore pressure control system.

3. The tool of claim 1, wherein the housing sleeve actuates to clamp on to the Christmas tree cap adaptor of the wellbore pressure control system.

4. The tool of claim 1, wherein the at least two portions of the housing sleeve comprise:

a first portion having a first end and a second end;

a second portion having a first end and a second end; and wherein the first end of the first portion and the first end of the second portion are coupled together and the second end of the first portion and the second end of the second portion are coupled together.

5. The tool of claim 4, further comprising:

a spring hinge rotatably coupling the first end of the first portion to the first end of the second portion; and a lock positioned on the second end of the first portion to optional lock the second end of the first portion to the second end of the second portion.

6. The tool of claim 1, wherein an inner surface of the housing sleeve comprises grooves.

7. The tool of claim 1, wherein the lifting hand further comprises a hook extending from the lifting hand to engage the lifting key.

8. The tool of claim 1, wherein the lifting key comprises:

a shaft comprising a first end and a second end, the first end configured to couple to the cap; and a ring coupled to the second end, wherein the lifting hand engages the ring to remove the cap from the Christmas tree cap adaptor.

9. The tool of claim 1, wherein the hydraulic reservoir supplies the hydraulic fluid to the piston responsive to the lever operating to move the lifting hand.

* * * * *